US006380906B1

(12) United States Patent
Cesulka

(10) Patent No.: US 6,380,906 B1
(45) Date of Patent: Apr. 30, 2002

(54) AIRBORNE AND SUBTERRANEAN UHF ANTENNA

(75) Inventor: John L. Cesulka, Ft. Walton Beach, FL (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 09/832,453

(22) Filed: Apr. 12, 2001

(51) Int. Cl.[7] ..... H01Q 13/00
(52) U.S. Cl. ..... 343/773; 343/705; 342/2
(58) Field of Search ..... 343/705, 708, 343/773, 719; 342/2, 29, 33, 36, 153, 425; 166/60; H01Q 13/00, 1/28, 17/10

(56) References Cited

U.S. PATENT DOCUMENTS

| | | | | | |
|---|---|---|---|---|---|
| 3,170,519 | A | | 2/1965 | Haagensen | 166/60 |
| 3,346,864 | A | | 10/1967 | Harmon | 343/719 |
| 3,435,457 | A | | 3/1969 | Brueckmann | 343/719 |
| 3,465,251 | A | * | 9/1969 | Meek et al. | 325/112 |
| 3,594,798 | A | | 7/1971 | Leydorf | 343/719 |
| 3,680,130 | A | * | 7/1972 | Johns, Jr. et al. | 343/708 |
| 3,737,906 | A | * | 6/1973 | Maynard | 343/705 |
| 3,803,616 | A | | 4/1974 | Kopf et al. | 343/719 |
| 4,074,268 | A | * | 2/1978 | Olson | 343/106 R |
| 4,140,179 | A | | 2/1979 | Kasevich et al. | 166/248 |
| 4,140,180 | A | | 2/1979 | Bridges et al. | 166/248 |
| 4,144,935 | A | | 3/1979 | Bridges et al. | 166/248 |
| 4,196,329 | A | | 4/1980 | Rowland | 219/10.81 |
| 4,301,865 | A | | 11/1981 | Kasevich et al. | 166/248 |
| 4,320,801 | A | | 3/1982 | Rowland et al. | 166/248 |
| 4,448,106 | A | | 5/1984 | Knapp | 89/1 A |
| 4,449,585 | A | | 5/1984 | Bridges et al. | 166/248 |
| 4,457,365 | A | | 7/1984 | Kasevich et al. | 166/60 |
| 4,461,039 | A | * | 7/1984 | Hersman | 455/326 |
| 4,487,257 | A | | 12/1984 | Dauphine | 166/60 |
| 4,498,535 | A | | 2/1985 | Bridges | 166/248 |
| 4,513,815 | A | | 4/1985 | Rundell et al. | 166/57 |
| 4,592,423 | A | | 6/1986 | Savage et al. | 166/248 |
| 4,679,748 | A | | 7/1987 | Blomqvist et al. | 244/3.19 |
| 4,687,445 | A | | 8/1987 | Williams | 343/719 |
| 4,697,192 | A | * | 9/1987 | Hofer et al. | 343/895 |
| 4,742,305 | A | | 5/1988 | Stolarczyk | 324/334 |
| 4,772,891 | A | * | 9/1988 | Svy | 343/707 |
| 4,809,010 | A | | 2/1989 | Losee | 343/719 |
| RE33,458 | E | | 11/1990 | Stolarczyk | 324/334 |
| 5,038,152 | A | * | 8/1991 | Wong et al. | 343/756 |
| 5,479,182 | A | * | 12/1995 | Sydor | 343/895 |
| 5,586,213 | A | | 12/1996 | Bridges et al. | 392/312 |
| 5,705,967 | A | | 1/1998 | Pirard | 333/237 |
| 5,829,519 | A | | 11/1998 | Uthe | 166/60 |
| 6,020,854 | A | * | 2/2000 | Jagnow et al. | 343/705 |
| 6,151,276 | A | | 11/2000 | Peinetti | 367/139 |
| 6,175,341 | B1 | * | 1/2001 | Noir et al. | 343/915 |

* cited by examiner

*Primary Examiner*—Don Wong
*Assistant Examiner*—Trinh Vo Dinh
(74) *Attorney, Agent, or Firm*—Gerald B. Hollins; Thomas L. Kundert

(57) ABSTRACT

A ruggedized ultra high radio frequency antenna disposable at the rear of a hardened target penetrator warhead is provided. The antenna is usable for communicating signals from a transmitter in a deployed target penetrator warhead to a local repeater where retransmission to a more remote location can occur. The antenna includes a length-shortening and penetration abuse-resistant dielectric embedding material also supporting the subterranean signal communication to the local repeater function. Antenna radiating element fabrication from porous material such as screen wire and use of the dielectric material in a manner providing large G force tolerance and external dielectric variations are included.

21 Claims, 4 Drawing Sheets

| Media | E | L in | L/2 | L/4 | F in MHz |
|---|---|---|---|---|---|
| Air | 1 | 38.549 | 19.274 | 9.637 | 303.825 |
| PTFE COAX | 2.1 | 26.791 | 13.396 | 6.698 | 437.158 |
| Poly-X COAX | 2.7 | 25.673 | 12.837 | 6.418 | 456.194 |
| | 3 | 22.256 | 11.128 | 5.564 | 526.240 |
| glass/dry sand | 4 | 19.274 | 9.637 | 4.819 | 607.650 |
| cities, industrial dry, dead soil | 5 | 17.239 | 8.620 | 4.310 | 679.373 |
| gypsum | 6 | 15.737 | 7.869 | 3.934 | 744.216 |
| slate | 7 | 14.570 | 7.285 | 3.642 | 803.845 |
| | 8 | 13.629 | 6.814 | 3.407 | 859.347 |
| | 9 | 12.850 | 6.425 | 3.212 | 911.475 |
| dry sand soil | 10 | 12.190 | 6.095 | 3.048 | 960.779 |
| | 11 | 11.623 | 5.811 | 2.906 | 1007.674 |
| rocky, mountainous soil | 12 | 11.128 | 5.564 | 2.782 | 1052.481 |
| concrete & medium hills, heavy clay soil | 13 | 10.691 | 5.346 | 2.673 | 1095.457 |
| dry rust & flat marshy densely wooded soil | 14 | 10.303 | 5.151 | 2.576 | 1136.809 |
| | 15 | 9.953 | 4.977 | 2.488 | 1176.709 |
| rich farmland | 20 | | | | |
| frest water | 80 | | | | |
| salt water | 81 | | | | |

*Fig. 3*

AIRBORNE AND SUBTERRANEAN UHF ANTENNA

RIGHTS OF THE GOVERNMENT

The invention described herein may be manufactured and used by or for the Government of the United States for all governmental purposes without the payment of any royalty.

CROSS REFERENCE TO RELATED APPLICATIONS

The present application is somewhat related to the U.S. patent application of applicants' Ser. No. 09/832,454 and 09/832,434 filed of even date herewith. The contents of these somewhat related applications are hereby incorporated by reference herein.

BACKGROUND OF THE INVENTION

As set forth in applicant's above identified patent document 09/832,454, when conducting military operations, and particularly airborne military operations, against an underground hardened target it is often difficult to assess the degree of success achieved in neutralizing the target from further enemy use.

In addition to the difficulty arising from the underground and hardened nature of many present day targets it may be appreciated that the gathering of target damage assessment information is often accomplished from a distant and moving vantage point, i.e., from a moving aircraft, an aircraft that has not approached or has not remained in the target area because of concern for its own safety from ground fire or other hostile threats. Moreover such target damage assessment is often desired in the situation wherein neither the attacking nor the assessing aircraft has been within viewing distance of the target during the entire operation—but has remained over the horizon or at some safe distance from the target and its probable defenses during both the weapon launch and success assessment phases of the operation. In any event it is clearly not desirable to require the attack aircraft or any related aircraft to either remain in the target vicinity for assessment purposes or for the aircraft to be required to return to the target area for assessment purposes or for a second neutralization attempt-particularly if such a second neutralization is not needed.

As a remedy for this success assessment difficulty the 09/832,454 document has disclosed a system for collecting tangible objective target arrival experience data from the warhead device itself and for making this data available at a remote mission analysis center or available to the pilot of the mission aircraft or to some other aircraft. One of the more technically challenging aspects of this data collection sequence resides in the provision of an antenna apparatus capable of satisfactory electrical performance and physical endurance in the subterranean as well as the airborne phases of a warhead delivery sequence. In addition the large deceleration forces expected in the course of a warhead arriving at the desired detonation point within the interior of a hardened underground target there are significant other environmental challenges to be tolerated by such an antenna. The present invention is believed to provide an attractive resolution of these difficulties.

SUMMARY OF THE INVENTION

The present invention provides a physically rugged ultra high radio frequency antenna suitable for both carriage on an airborne warhead weapon and for use during a subsequent subterranean travel and deceleration impact inclusive intervals of the warhead. The antenna invention particularly includes structural and electrical attributes responsive to harsh environmental conditions.

It is therefore an object of the present invention to provide an ultra high radio frequency antenna capable of being mounted in the limited confines of a guidance tail kit attached to a munitions warhead device.

It is another object of the invention to provide an ultra high radio frequency antenna that is capable of withstanding the physical abuse attending a high-speed penetration of multiple tens of feet of earth and reinforced concrete layers by a penetrating warhead device.

It is another object of the invention to provide an ultra high radio frequency antenna remaining electrically usable notwithstanding presence in a dielectrically changing debris field of additionally varying electrical properties.

It is another object of the invention to provide a process by which an antenna meeting these objects can be fabricated without expensive machining.

It is another object of the invention to provide an apparatus capable of accommodating a transitional airborne to subterranean impact shock environment while functioning as an ultra high frequency antenna apparatus.

It is another object of the invention to provide a "cone monopole" extension of the monopole antenna, an antenna suitable for use under extreme environmental conditions.

These and other objects of the invention will become apparent as the description of the representative embodiments proceeds.

These and other objects of the invention are achieved by ruggedized transitional airborne to subterranean environment ultra high frequency antenna apparatus comprising the combination of:

an electrically conductive ground plane member disposed on a rearward portion of an air deliverable earth and concrete penetration military weapon and including an aperture opening in a central portion thereof;

a layer of electrical insulation material sufficient to decouple said ground plane from a body portion of said military weapon and preclude excessive weapon nose-directed radiation;

an electrically conductive radiating element of ultra high frequency tunable length, disposed normal to said ground plane, located at said central portion aperture opening and extending rearward of said military weapon device;

said electrically conductive radiating element having both an inverted upstanding conical shape with a conical apex electrical node disposed at said central portion aperture of said electrically conductive ground plane member but in electrical isolation therefrom and having a conical base portion disposed substantially parallel with and separated from said electrically conductive ground plane member;

said electrically conductive radiating element being comprised of porous electrically conductive material disposed in a closed conical surface geometric configuration;

a mass of cured resin dielectric material surrounding, embedding and impregnating said porous radiating element and extending from a radiating element-adjacent face of said electrically conductive ground plane member rearward of said military weapon device;

said mass of cured resin dielectric material also surrounding, embedding and impregnating a porous element comprising said ground plane member and additionally including a portion extending forward along said military weapon and supporting transmitter electronics apparatus of said military weapon device;

said cured mass of dielectric material having a dielectric constant greater than that of air and tending to increase an effective electrical length characteristic of said electrically conductive conical shape radiating element in excess of a physically-determined nominal ultra high frequency electrical length characteristic thereof;

said cured mass of resin material also having external physical shape and dimensions compatible with surrounding portions of said military weapon device and compatible with earth and target penetration deceleration forces predicted for said military weapon device.

BRIEF DESCRIPTION OF THE DRAWING

The accompanying drawings incorporated in and forming a part of the specification, illustrates several aspects of the present invention and together with the description serve to explain the principles of the invention. In the drawings:

FIG. 3 shows a table of dielectric constants and antenna length dimensions relevant to a present invention antenna.

DETAILED DESCRIPTION OF THE INVENTION

Figure 1:
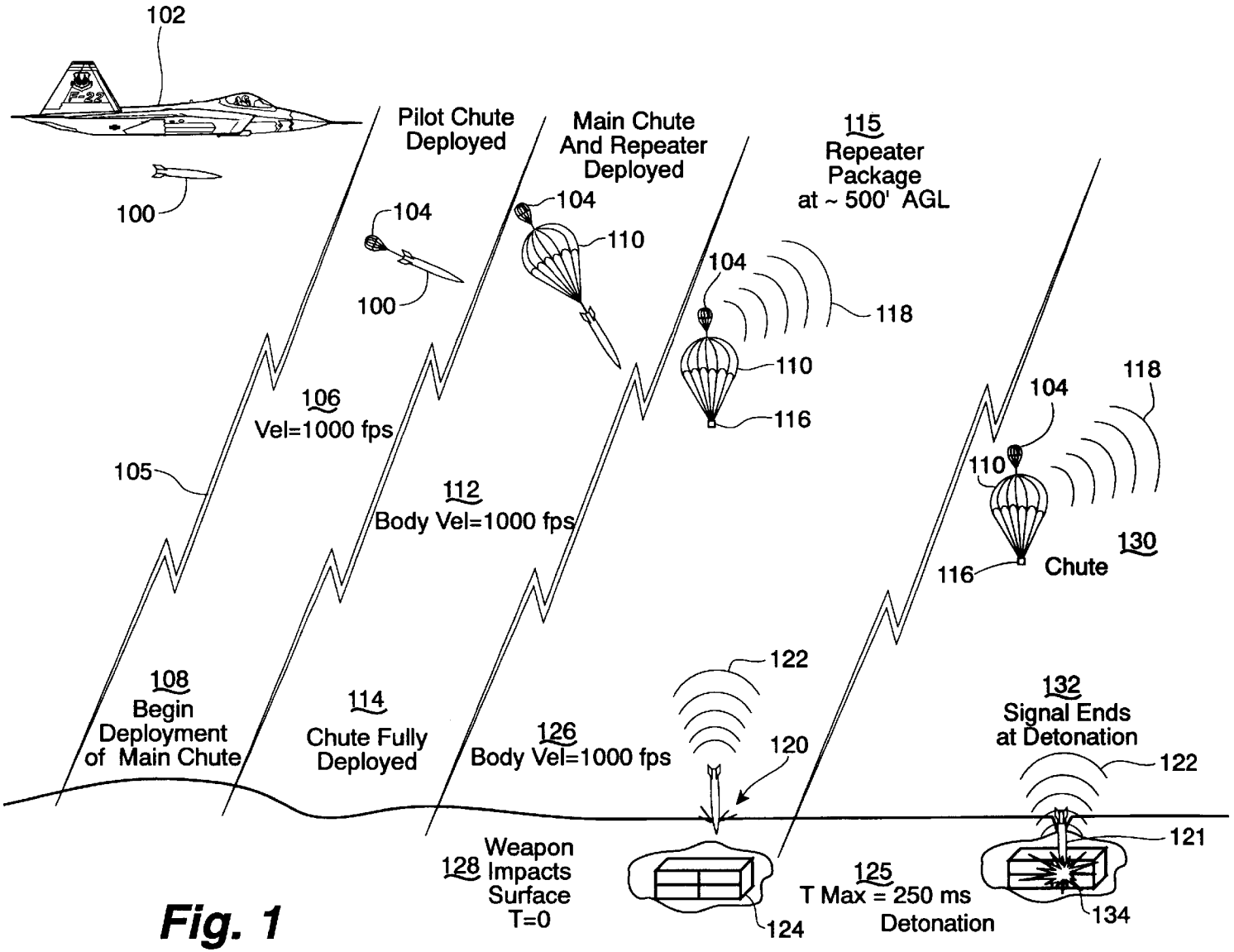
FIG. 1 shows a deployment sequence for a hardened target signal-communicating warhead device employing the present invention to advantage.
Figure 2:
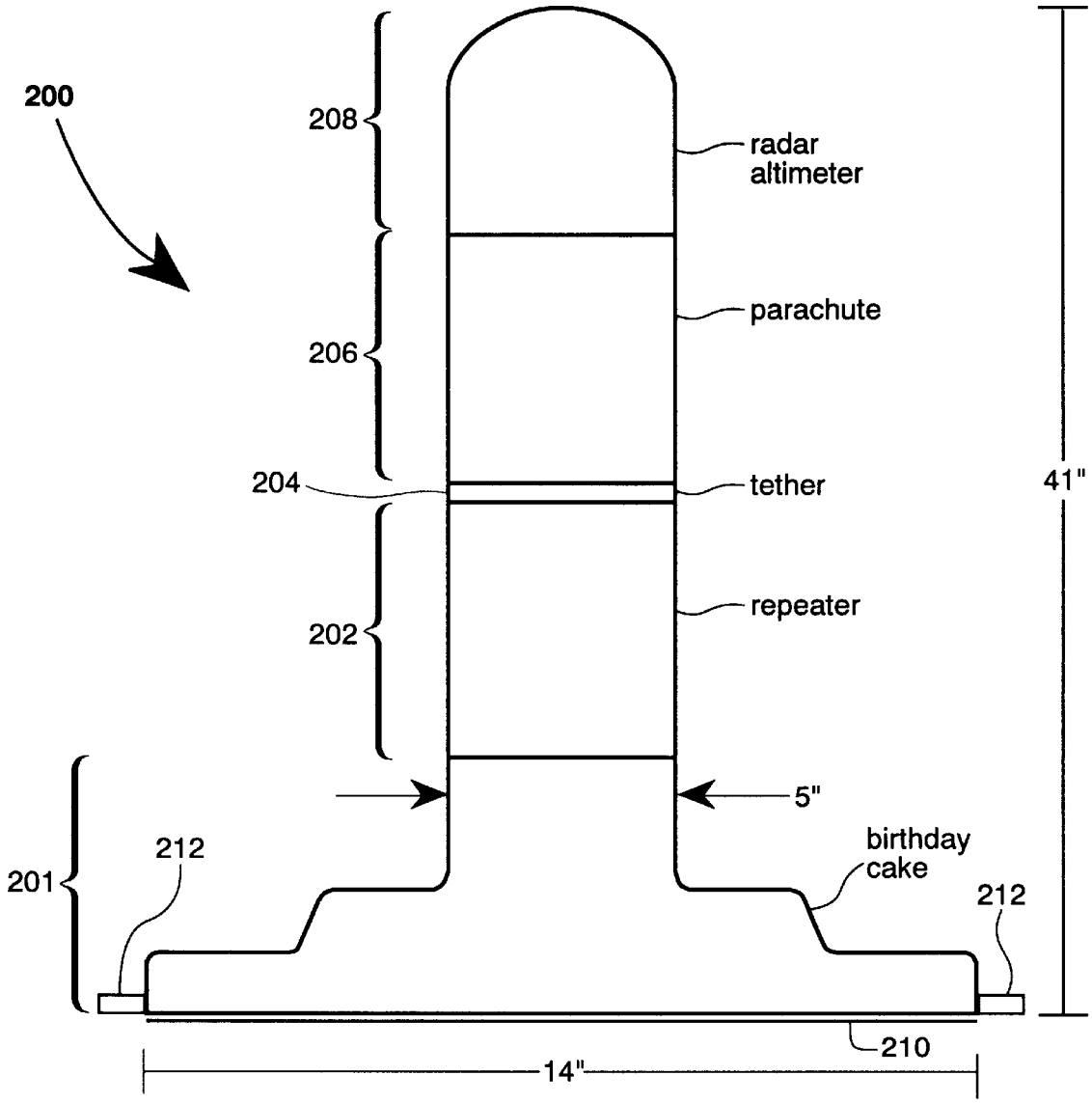
FIG. 2 shows a pre deployment package of components supporting the FIG. 1 sequence including the present invention antenna.

FIG. 1 and FIG. 2 in the drawings originate in applicants' above identified patent application Ser. No. 09/832,454 and are included here along with related specification description in order to provide stand alone background information relating to the present invention antenna, an antenna desirably used in the communication system of the application Ser. No. 09/832,454. In the FIG. 1 drawing there is represented a time sequence of events occurring after release of the weapon device 100 by an aircraft 102. Each event in this FIG. 1 sequence is isolated from preceding and succeeding events by the divider symbols 105. Following deployment of the weapon device 100, which may occur at a representative aircraft velocity of 1000 feet per second 682 miles per hour) as indicated at 106, 112 and 126 in the FIG. 1 drawing, an altimeter device 208 in FIG. 2 which becomes exposed beyond the weapon device tail section, ay be used to deploy a main parachute 110 in order to separate a radio frequency repeater device 116 (202 in FIG. 2) from the weapon device 100 during its airborne flight phase. As indicated by the weapon device velocity values at 106, 112 and 126 in FIG. 1 the parachutes 104 and 110 are arranged to extract the repeater device package while it is airborne rather than to decrease the velocity of the weapon device appreciably. Orientation of the weapon device is provided by a tail kit guidance package in order to attain a penetration attitude substantially normal to the earth's surface and thereby prevent bounce or skip of the weapon device. The purpose of the parachutes 104 and 110 is therefore to extract the repeater with sufficient flight time remaining to receive an ensuing subterranean penetration data history and detonation-indicator signal from the penetrating warhead.

At some altitude such as the 500 feet indicated at 115 in FIG. 1, the FIG. 2 altimeter 208 jettisons itself allowing the repeater package 116 to be extracted from a rearward cavity of the weapon device 100 while the warhead remainder of the device is allowed to continue with fin guidance toward the impact-penetration event represented at 120 in FIG. 1. Shortly after impact the tail fins are stripped off by penetration events thus exposing the tail transmitter of the invention, as it is located in a rearward portion of the weapon device 100. The signals represented at 122 in FIG. 1, are emitted and received in the repeater package 116 and retransmitted at some convenient frequency to a remote location where recording and detailed analysis of the weapon device 100 experiences may be accomplished. Such retransmission may use any of several known techniques including communicating by a telemetry method. The most significant portion of these signals 122 and 118 of course occur commencing with the T=0 weapon to surface impact indicated at 120 in FIG. 1 and ensue for a period such as the 250 milliseconds indicated at 125.

During at least part of the 250 milliseconds interval indicated at 125 in FIG. 1 the repeater 116 may remain airborne via the parachutes 104 and 110 in order to achieve efficient communication with a receiver located at a distant mission analysis center; signals of any convenient frequency including microwave, UHF, infrared or other frequencies may be used for this communication. Efficient communication with the penetrating weapon 100 may be assured by tethering the repeater and its parachute to the weapon. The tether will slacken or break at impact allowing the repeater to descend more slowly as it listens and relays data signals from the burrowing transmitter. Alternately in some arrangements of the invention it may also be desirable to locate the repeater on the earth's surface rather than in the air during this communication period. Since the effects of such subterranean signal communication include communicated signal polarization changes and since the repeater receiver and its antenna may be rotating or moving it is desirable for the repeater receiving the subterranean signals to be capable of receiving multiple different signal polarizations without significant signal degradation.

During the 250-millisecond interval at 125 in FIG. 1, accelerometer and other desired signals descriptive of the penetration experiences of the weapon device 100 are communicated to the mission analysis center preferably in real time although a delayed communication capability may be incorporated into the repeater 116. These signals may include a final signal indicating energization of or an actual detonation of a fuze and a main warhead charge in the weapon device 100 as is represented at 134 in FIG. 1. Variations in the FIG. 1 sequence are of course possible within the scope of the present invention. Such variations may include for example launch of the weapon device 100, or a related device such as a cannon sized device, from a ground-based or airborne cannon, communication of the munitions penetration data to the aircraft pilot or other crewmember or to an aircraft recorder in lieu of or in addition to communication to an analysis center, absence of one or more of the parachutes 104 and 110 and communication of additional or different signals from the weapon device 100.

Deceleration forces measuring in the range of 22,000 times the force of gravity have been measured in connection with the impact of the weapon device 100 with the concrete of a buried hardened target as represented at 124 in FIG. 1. Since such impact events precede the occurrence of events providing some of the most useful information from the weapon device 100, i.e., precede the occurrence of penetrations within the target 124 and the final detonation of the warhead within the target 124, it is necessary for the communications apparatus accompanying the weapon device 100 to tolerate the forces resulting from these decelerations and other environment effects.

FIG. 2 in the drawings shows a physical representation of communication components usable with an exemplary hardened target penetrator device, the U.S. military BLU-109 weapon, in performing the FIG. 1 data collected target neutralization sequence. The FIG. 2 components are intended to be located on the rear of for example a BLU-109 weapon, extending backward from the normal rear face of the device and are received in a cylindrical cavity of a guidance fin kit that also occupies this rear face location on the weapon; this fin kit and the other rearward portions of the FIG. 2 apparatus are not shown in FIG. 2 for the sake of drawing simplicity. These fin kit components are stripped from the weapon as impact occurs exposing the burrowing "birthday cake" transmitter-antenna assembly 201. This "birthday cake" assembly is the location of the present invention antenna and therefore accompanies the BLU-109 weapon beyond impact. This assembly is, along with electronic components not shown in FIG. 2, therefore arranged to be impact tolerant as is discussed subsequently herein. The FIG. 2 drawing also shows possible outline dimensions for the represented components. Such dimensions include the overall "birthday cake" assembly diameter near 14 inches, a diameter of 5 inches for the repeater and other pre deployed components and an overall height 416 of these components of 3.5 feet or 42 inches.

With this explanatory preliminary description it is now possible to focus on the antenna of the present invention. Generally it may be stated that the antenna needed for the FIG. 1 system should provide omni directional hemispherical radiation in a portion of the ultra high radio frequency spectrum that is at least free of known enhanced subterranean signal absorbing characteristics and provide this radiation while remaining as immune as is possible from characteristic changes caused by the expected earth and target penetration sequences. Moreover it is necessary for the selected antenna to remain fully operational while enduring the most hostile of these environmental conditions and notwithstanding an absence of satisfying knowledge of the soil and soil moisture conditions to be encountered during worldwide use of the data collecting target neutralization apparatus. These needs are of course in addition to the need to tolerate the large G forces expected during weapon device 100 penetrations.

The "frequency independent" antenna configuration wherein, for example a log periodic or collinear dipole of either balanced or unbalanced configuration is operated in a $1^{st}$, $2^{nd}$, $3^{rd}$, $4^{th}$ and so-on multiple of some lowest operating frequency offers considerable attraction for use in the present invention environment. In the present invention subterranean environment such a multi-frequency antenna arrangement may be employed not so much in accommodation of different frequency inputs, but rather in accommodation of changes in its environment that effectively change its length so that it better suits other frequencies. Dielectric constants of media denser than air slow the antenna-radiated wave as if it were longer i.e., as if it were of a lower frequency. A quantitative appreciation of these changing environmental conditions as, described by their constituent dielectric constants, on an antenna intended for use in the FIG. 1 data collected target neutralization sequence may be gained from the data appearing in the table of FIG. 3 in the drawings.

In the table of FIG. 3 there is listed in the second table column a range of dielectric constants, E, ranging between 1 and 81, E values relevant to air and salt water media respectively. The first column of the FIG. 3 table identifies several everyday locations where soil conditions characterized by the dielectric constant values listed in column 2 of FIG. 3 are to be expected. Most of the constants of value greater than 4, a constant which would double the electrical length of a fully immersed antenna, are possible environments in which the communication system of FIG. 1 and the antenna of the present invention should be fully operational if the system is to be effective in real world military environments; the dielectric constants of 80 and 81 being possible exceptions to this requirement. In considering the table of FIG. 3 and its influence on antenna configuration it may be helpful to appreciate that generally the electrical length of an antenna made according to the table data varies in accordance with the square root of the dielectric constant of the media surrounding the antenna. That is $$L_A(\text{dirt})=L_A(\text{vacuum})\times(\text{dirt dielectric constant})^{1/2} \quad (1)$$

Where $L_A$ represents antenna length and the exponent ½ indicates square root.

Equation 1 applies if the antenna is totally immersed in a pure material. The practical significance of equation 1 is also proportional to the intensity of the antenna's electric field at the point of dielectric contact and most of the dielectric effect is within the first quarter wavelength normal to the conductor. For the antenna of the present invention the real dielectric constant is an undefined average of the material in the debris hole formed by the penetrating weapon; that is the air, moisture, silica, rust, concrete etc. material near the antenna determine the real dielectric constant. The cone monopole of the present invention moreover has maximum dielectric interaction at the extremity where current is nearest zero and thus the voltage is maximum. One aspect of the present invention involves adding resin past this point so that the effective dielectric constant is dominated by the resin rather than the earth and debris changes adjacent the antenna. This arrangement may be likened to holding the dielectric changes at arm's length with resin.

In the present invention moreover it is desirable for the antenna to be tuned for maximum efficiency i.e. best match, with representative penetration soil disposed near the antenna tip. Such a procedure diminishes the effect of soil penetration signal dynamics (i.e. the rapid signal strength changes experienced during initial antenna penetration) at the receiver/repeater represented at 116 in FIG. 1 by causing the highest antenna efficiency to occur when the media attenuation is greatest. The present invention antenna may also incorporate broad banding arrangements such as the frequency independent antenna techniques previously discussed in furtherance of this characteristic.

In the third column of the FIG. 3 table, are shown the antenna physical lengths required for an electrical length of one wavelength at an ultra high radio frequency operating frequency of 303.825 megahertz, the operating frequency of the RF Monolithics RX1120 ASH receiver identified in the patent application Ser. No. 09/832,454, (which has been incorporated by reference herein). These antenna physical lengths assume the antenna is operating in an environment having the column 1-listed dielectric constant. Notably these one-wavelength dimensions vary between 38.549 inches and 9.953 inches for the dielectric constants of 1 and 15 respectively. For the more weapon-practical half wave or quarter wave antenna lengths, the 19.274–4.977 and 9.637–2.488 inch dimensions in column four and five of the FIG. 3 table are relevant. Notably therefore, if the present invention improvements are excluded from the weapon device, these FIG. 3 column four and five length variations represent transmitter loading conditions the system, and especially the 200 watt transmitter located on the weapon device 100 in FIG. 1, must tolerate during typical penetration operation.

Clearly such effective antenna length-changed operation of a transmitter as represented in the FIG. 3 table presents difficulty in the form of impedance mismatches, excessive standing wave ratio magnitudes, unexpected voltages (of semiconductor device rupture capability) generated in the final amplifier stage of a transmitter circuit and other difficulties. Significantly it must be remembered that the FIG. 3 antenna length-related difficulties arise only because of the contemplated variation in surrounding environment dielectric constant to be expected during operation of the FIG. 1 system. In fact a large range of such length variations may be encountered during a single penetration event when typically successive conditions of for example dry sand, wet sand, wet clay, wet concrete and dry air (air inside the target 124) may be encountered in sequence as the weapon device 100 performs the hardened target 124 neutralization represented at 120 and 134 in FIG. 1. Resin dielectric loading and broad banding with resin thickness at antenna high voltage points as described in the preceding paragraphs minimize these detuning effects.

In fact the precise quantitative nature of an environment accompanying a FIG. 1 penetration event is the subject of some conjecture in the weapons development field. It is known for example that the earth strike event represented at 120 in FIG. 1 generates a plume of loosened particles that stay close-in behind the penetrator and that this plume may include moisture (E=50), sand/silica (E=4) particles, rock fragments (E=7), vaporized/charred resin materials (E=?) and other components. In the present invention this array of components is the media through which the desired radio frequency communication signal is to be propagated (in addition to propagation through the relatively undisturbed adjacent earth) and also the array of components determining the effective length and other characteristics of the employed ultra high radio frequency transmitting antenna.

When these electrical difficulties are viewed from a perspective also mindful of the physical considerations arising from deceleration forces in the 22,000 G. range to be tolerated during the FIG. 1 penetration sequence, it is clear that drastic changes to a simple exposed fractional wavelength ultra high radio frequency antenna are needed in the FIG. 1 system. One answer to this need is the subject of the present invention and is disclosed schematically in the FIG. 4 drawing herein. The FIG. 4 drawing therefore shown a one-quarter wavelength omni directional ground plane antenna to be contained in a "birthday cake" assembly 201 for a BLU-109 U.S. military munitions device as these elements are disclosed in the patent application Ser. No. 09/832,454.

Figure 4:
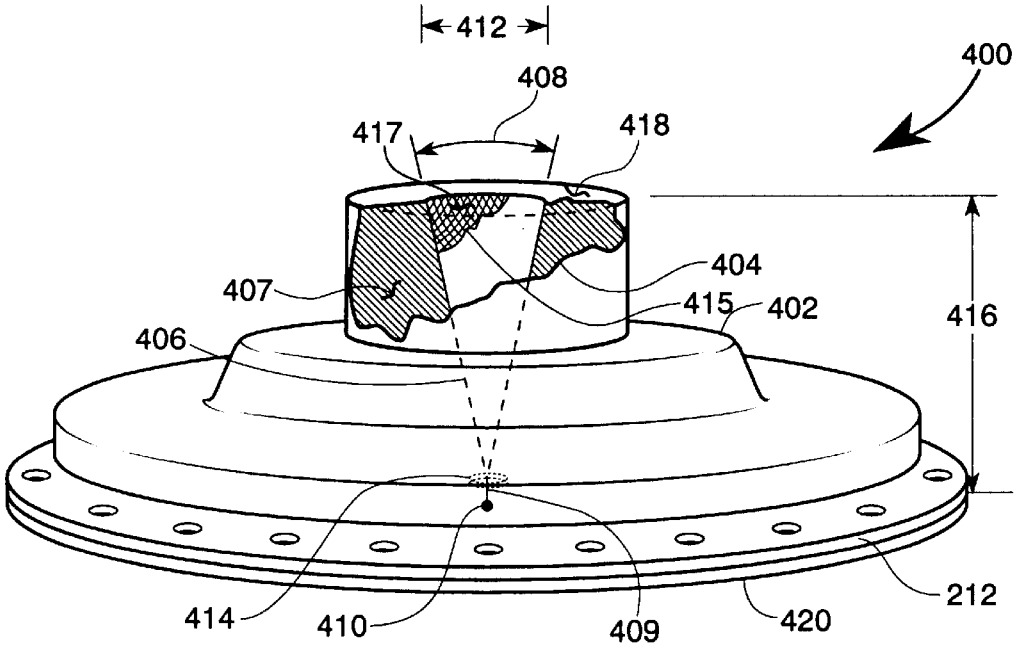
FIG. 4 shows a cutaway perspective view of a preferred arrangement of the present invention antenna.

In the FIG. 4 drawing there is therefore shown a perspective view of a BLU-109 "birthday cake" assembly 400 in which is contained an antenna element 406 and attending components all together of which are capable of performing in the FIG. 1 penetration system. As shown in FIG. 4 the "birthday cake" assembly 400 consists of a molded heat cured resin material body portion (of FIG. 3 E~5) 402 configured to reside within the optional tail fin kit of the BLU-109 warhead device disclosed in the patent application Ser. No. 09/832,454. Also shown in FIG. 4 is the mounting flange 212 with which both the "birthday cake" assembly 400 and the optional fin kit are attached to the rear flange of the BLU-109 device. Additionally appearing in the FIG. 4 drawing are the two cutting lines 404 and 415 (by which internal portions of the "birthday cake" assembly and the antenna element 406 are made more visible). Also represented are the angular measurement line 408 and the antenna transmission line and terminal node elements 408 and 410.

The antenna ground plane element 210 discussed in the patent application Ser. No. 09/832,454 is not shown in the perspective of the FIG. 4 drawing but is desired at the lowermost face of the "birthday cake" assembly. The ground plane includes the aperture 414 discussed below and may be fabricated from an integral sheet of conductive metal or from a textured material such as woven wire conductors or woven non metallic conductors that have been treated to be electrically conductive. The ground plane is preferably disposed in electrical isolation from the body of the weapon device 100 in order to avoid antenna pattern changes such as a pattern shifting forward along the weapon device. Electrical isolation may also include radio frequency decoupling through the use of ferrous and carbon energy absorbing materials that attenuate magnetic and electric interaction between the antenna and its weapon device platform; a layer of such material is represented at 420 in FIG. 4.

The antenna element 406 in FIG. 4 is preferably shaped in the form of an inverted conical section that is provided with an angle 408 between opposed conical surface elements. The angle 408 preferably is made to be in the range of thirty degrees and the open end of the conical surface has a diameter near one and one-half inches as is represented at 412 in FIG. 4. The closed apex of the conical surface is disposed adjacent an opening 414 in the ground plane element 210 and is connected to a short transmission line element 409 terminating in the electrical node 410. The opposite end of this transmission line is connected to the transmitter source of radio frequency energy for the antenna element 406. Although the antenna element 406 may be fabricated from sheet material such as copper, brass, aluminum, titanium or most other metallic or otherwise conductive materials, and is preferably made porous in nature, for reasons relating to impact resistance as discussed below herein, I prefer to fabricate the antenna element 406 from a conductive screen wire made from such materials as copper, brass or bronze. A representation of such material, appearing to be exposed by the second cutting line 415, is identified at 417 in FIG. 4. The seam wherein closure of the antenna 406 conical surface occurs may be accomplished by soldering, brazing, riveting spot welding or other attachment arrangements known in the metal fabrication art. With use of riveting or other mechanical fastening in the conical surface closure, screen wire made of aluminum or other more difficult-to-attach materials may be used for the antenna element 406. Carbon impregnated fiberglass or other conductive material arrangements may also be arranged for use in the FIG. 4 antenna element 406.

In view of concurrent needs relating to the combination of antenna physical size, antenna electrical size and antenna physical strength, the selection of a material suitable for use in the resin material body portion 402 of the FIG. 4 "birthday cake" assembly is a significant aspect of the present invention. With a careful selection, this resin material can in fact provide physical rigidity sufficient to withstand the 22,000 G's of deceleration force expected for the FIG. 4 antenna and also provide a desirable reduction in the physical dimensions needed for an antenna of specified frequency and operating wavelength. The latter of these benefits occurs in the manner suggested by an additional review of the column 2 and column 5 data in FIG. 3 of the drawings. In these columns a comparison of antenna environment dielectric constant with antenna length requirements for one possible ultra high radio frequency operating frequency are disclosed. From the FIG. 3 table for example with use of a material having a dielectric constant of 5 surrounding the antenna element, the needed quarter wavelength antenna element at 406 is reduced from 9.637 inches to 4.310 inches in physical length in comparison with an air surrounded antenna--a reduction factor better than one-half. Clearly a 4.31-inch antenna is more easily disposed in the limited space of a munitions device such as in FIG. 2 than is a 9.637-inch antenna. At the same time such a dielectric mitigates the changing dielectric effects of external debris.

One material found to be suitable for the resin material body portion 402 of the FIG. 4 "birthday cake" assembly is the heat curable urethane resin identified as the type D-65 Monothane manufactured by the Synair corporation of Chattanooga, Tenn., USA. When heat-cured at 180° F. this material provides a dielectric constant in the range of 5.0, a value between that of dry sand and slate in the table of FIG. 3, and is therefore capable of shortening the antenna element 406 by the above indicated better than one half with respect to the same antenna disposed in air. The quantity of urethane resin used in the FIG. 4 assembly appears somewhat excessive with respect to the size of the antenna element 406 however this material may be considered to include components serving several functions in the FIG. 4 assembly. These functions may be viewed as supporting the radiating conductor element or antenna element 406 in its selected element configuration shape by embedding the element within a first quantity of the urethane i.e., within a hardenable resin dielectric material. The quantity of material shown may also be considered to include material added to the first quantity of hardenable dielectric material as a second quantity of size and location capable of fixing the electrically conductive ground plane and radiating conductor elements in their suspended, perpendicular, electrically isolated locations.

Additionally, the illustrated material may be considered to supplement the first and second quantities of hardenable resin dielectric material with a third quantity of material capable of permanently supporting said ground plane and radiating conductor elements in their suspended, perpendicular, electrically isolated locations in the presence of earth penetration munitions device generated deceleration forces of selected magnitude. The illustrated material may also be considered to include portions complementing the first, second and third quantities of hardenable resin dielectric material with a fourth quantity of material disposed in selected amount and location on the antenna assembly to isolate the radiating conductor element from electrical characteristic destabilizing debris and moisture products of the munitions device earth penetration. The first, second, third and fourth quantities of hardenable resin dielectric material are of course melded into a single quantity of material when disposed in a mold and then heat cured into a unified mass receivable in a selected cavity portion of the earth penetration munitions device.

Even though the FIG. 4 representation of an antenna according to the present invention includes use of these larger amounts of nonconductive urethane resin material, a careful optimization of the present invention antenna may consider several possibilities for reducing the mass and material usage in this assembly. Encompassed within these possibilities is the fact that solely with respect to electrical characteristics, there is little need for resin material surrounding the lower conical apex portions of the FIG. 4 assembly since this is a region of maximum current and minimum voltage in the antenna element 406 and the approach of moisture and debris components adjacent this portion of the antenna element is of little antenna function consequences. This possibility must of course be carefully considered in light of the need for physical strength and retention of the ground plane element 210 in the illustrated (and electrically isolated from the weapon body to prevent undesirable antenna field pattern distortions) conditions. Other mass reduction possibilities include the use of lower density other materials in non-critical portions of the FIG. 1 antenna assembly including for example the intentional introduction of air bubble or foaming in certain limited portions of the plastic resin (normally vacuum evacuation of entrained air is preferred for the FIG. 4 resin prior to its curing). Additionally the volume of resin inside the cone may be reduced and only enough mass used as needed to support a dielectric cap distancing the dielectrically changing debris that follows the penetrating weapon.

In addition to contributions in the area of physical strength and more favorable ratios of physical to electrical length for the antenna element 406 the resin material surrounding this antenna element 406 in FIG. 4 serves additional useful purposes in the present invention. From an examination of the upper surface of the "birthday cake" assembly 201 at 418 in the FIG. 4 drawing for example it may be observed that the resin material (in keeping with the discussions above) provides a significant degree of lateral physical separation between the conical conductor of the antenna element 406 and the closest possible approach of the debris field components following the warhead device 100 during the penetration commencing at 120 in FIG. 1. This physical separation is of course most significant with respect to electrical properties at the open end or distal end of the antenna element 406 where the antenna operates with a maximum of radio frequency voltage and a minimum of radio frequency current.

For testing and adjustment purposes the length of the antenna element 406 may conveniently be altered following molding merely by cutting off portions of the FIG. 4 assembly at its upper face 418 until an optimum antenna length is attained. Although this technique is useful for test and setup purposes the fact that such cutting leaves conductor thickness portions of the antenna exposed to the atmosphere and the debris field falling in behind a penetrating warhead device suggests the desirability of adding an additional subsequent layer of the plastic resin material or some other material to cover the cut surface. Alternatively, for tuning purposes the antenna may be electrically shortened by adding a suitable series capacitance at the apex of the cone (with due consideration of capacitor G-force susceptibility). Once a fabrication process for the FIG. 4 assembly has been stabilized and antenna element length cutting is no longer needed, the initial molding may include material adequately covering the face at 418.

The resin material surrounding the antenna element 406 in the present invention therefore serves a plurality of significant functions in making the UHF antenna of the present invention practical. These functions may be categorized as follows:

1. Providing protection of the radiating element from physical damage; damage resulting from relative motion between the radiating element and nearby surrounding objects for example.

2. Providing physical support for the radiating element, support made necessary by a structurally weak disposition of the electrically determined radiating element configuration.

3. Holding 3-D or multi dimensional radiating element portions of the antenna in a desired physical configuration; the conical screen wire radiating element shape being for example maintained in the described embodiment of the antenna.

3. Providing mounting attachment element integration with the antenna radiating elements, (elements such as embedded threaded sleeves for example may be integrated with the antenna by way of this function.)

4. Providing separation and limited electrical coupling between the antenna radiating element and surrounding media of varying dielectric properties; surrounding media objects such as soil, moisture, rocks appearing in an earth penetration application of the antenna.

5. Providing electrical lengthening of the antenna-radiating element with respect to the same element used in a surrounding air environment of near unity dielectric constant. Viewed from a slightly different perspective this function enables use of a smaller radiating element to achieve the desired electrical resonance condition for any antenna operating frequency.

The foregoing description of the preferred embodiment has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the inventions in various embodiments and with various modifications as are suited to the particular scope of the invention as determined by the appended claims when interpreted in accordance with the breadth to which they are fairly, legally and equitably entitled.

I claim:

1. Conical monopole ruggedized transitional airborne to subterranean environment ultra high frequency antenna apparatus comprising the combination of:

an electrically conductive ground plane member disposed on a rearward portion of an air deliverable earth penetration military weapon device;

an upstanding electrically conductive radiating element of ultra high frequency tunable length located in a central portion of said ground plane member and extending rearward of said military weapon device;

said electrically conductive radiating element having both an inverted upstanding conical shape with a conical apex electrical node disposed adjacent said electrically conductive ground plane member while in electrical isolation therefrom and a conical base portion disposed generally parallel with and separated from said electrically conductive ground plane member;

said electrically conductive radiating element being comprised of porous electrically conductive material disposed in a closed conical surface geometric configuration;

a mass of cured elastic urethane resin dielectric material surrounding, embedding and impregnating said porous radiating element, ground plane, and extending from a radiating element-adjacent face of said electrically conductive ground plane member rearward of said military weapon device;

said cured mass of urethane resin material having a dielectric constant greater than that of air and tending to increase an effective electrical length characteristic of said electrically conductive radiating element in excess of a physically-determined nominal ultra high frequency electrical length characteristic thereof;

said cured mass of resin material also having external physical shape and dimensions compatible with a surrounding rearward receptacle portion of said military weapon device and compatible with earth and target penetration deceleration forces predicted for said military weapon device.

2. The conical monopole ruggedized transitional airborne to subterranean environment ultra high frequency antenna apparatus of claim 1 wherein said electrically conductive ground plane member is suspended in electrical isolation from said earth penetration military weapon device.

3. The conical monopole ruggedized transitional airborne to subterranean environment ultra high frequency antenna apparatus of claim 1 wherein said electrically conductive radiating element and said electrically conductive ground plane member include coaxial transmission line termination nodes.

4. The conical monopole ruggedized transitional airborne to subterranean environment ultra high frequency antenna apparatus of claim 1 wherein said electrically conductive radiating element is comprised of cupreous screen wire.

5. The conical monopole ruggedized transitional airborne to subterranean environment ultra high frequency antenna apparatus of claim 1 wherein said electrically conductive radiating element is disposed in a conical shape of thirty degree apex angle.

6. The conical monopole ruggedized transitional airborne to subterranean environment ultra high frequency antenna apparatus of claim 1 wherein said resin dielectric material comprises a heat curable urethane resin material.

7. The conical monopole ruggedized transitional airborne to subterranean environment ultra high frequency antenna apparatus of claim 1 wherein said mass of resin dielectric material has an external physical shape of multi diametered birthday cake stack configuration receivable in a cavity of said earth penetration military weapon device.

8. The ruggedized transitional airborne to subterranean environment ultra high frequency antenna apparatus of claim 1 wherein said cured mass of resin dielectric material has a dielectric constant intermediate those of air and water.

9. The ruggedized transitional airborne to subterranean environment ultra high frequency antenna apparatus of claim 1 wherein said cured mass of resin dielectric material has a dielectric constant of substantially five.

10. The ruggedized transitional airborne to subterranean environment ultra high frequency antenna apparatus of claim 1 wherein said weapon device includes tail kit comprising aerodynamic finned members and wherein said antenna and associated apparatus are received in a cavity of said tail kit prior to weapon device delivery.

11. The ruggedized transitional airborne to subterranean environment ultra high frequency antenna apparatus of claim 1 wherein said electrically conductive radiating element has an electrical length when surrounded by said cured mass of resin dielectric material of resonant frequency in the 300 megahertz ultra high radio frequency band.

12. The ruggedized transitional airborne to subterranean environment ultra high frequency antenna apparatus of claim 1 wherein said apparatus further includes a layer of radio frequency energy decoupling material comprising one of ferrous and carbonaceous energy absorbing materials capable of attenuating magnetic and electric interaction between said antenna and said weapon device.

13. Ruggedized transitional airborne to subterranean environment ultra high frequency antenna apparatus comprising the combination of:

an electrically conductive ground plane member disposed on a rearward portion of an air deliverable earth and concrete penetration military weapon and including an aperture opening in a central portion thereof;

a layer of electrical insulation material sufficient to decouple said ground plane from a body portion of said military weapon and preclude excessive weapon nose-directed radiation;

an electrically conductive radiating element of ultra high frequency tunable length, disposed normal to said ground plane, located at said central portion aperture opening and extending rearward of said military weapon device;

said electrically conductive radiating element having both an inverted upstanding conical shape with a conical apex electrical node disposed at said central portion aperture of said electrically conductive ground plane member but in electrical isolation there from and having a conical base portion disposed substantially parallel with and separated from said electrically conductive ground plane member;

said electrically conductive radiating element being comprised of porous electrically conductive material disposed in a closed conical surface geometric configuration;

a mass of cured resin dielectric material surrounding, embedding and impregnating said porous radiating element and extending from a radiating element-adjacent face of said electrically conductive ground plane member rearward of said military weapon device;

said mass of cured resin dielectric material also surrounding, embedding and impregnating a porous element comprising said ground plane member and additionally including a portion extending forward along said military weapon and supporting transmitter electronics apparatus of said military weapon device;

said cured mass of dielectric material having a dielectric constant greater than that of air and tending to increase an effective electrical length characteristic of said electrically conductive conical shape radiating element in excess of a physically-determined nominal ultra high frequency electrical length characteristic thereof;

said cured mass of resin material also having external physical shape and dimensions compatible with surrounding portions of said military weapon device and compatible with earth and target penetration deceleration forces predicted for said military weapon device.

14. The method of communicating modulated ultra high radio frequency energy radio signals from an air delivered earth penetrating munitions device to a nearby above ground ultra high radio frequency receiver apparatus, said method comprising the steps of:

radiating said modulated ultra high radio frequency energy radio signals from initial earth-impact-preceding airborne locations of said munitions device to said above ground ultra high radio frequency receiver apparatus via an atmospheric signal path and from a munitions device-carried dielectrically loaded conical radiator radio frequency energy radiating antenna element;

communicating said modulated ultra high radio frequency energy radio signals from earth-impact-subsequent, earth and target penetrating, subterranean locations of said munitions device to said above ground ultra high radio frequency receiver apparatus via a subterranean earth-inclusive signal path and from said munitions device-carried dielectrically loaded conical radiator radio frequency energy radiating antenna element;

maintaining usable electrical characteristics in said munitions device-carried dielectrically loaded conical radiator radio frequency energy radiating antenna element during said earth and target penetrating subterranean locations-communicating by actions of supporting said conical radiator with selected quantities of a strengthening dielectric loading material and excluding earth-impact and earth-penetration-related moisture and debris particles from locations intimately proximate said conical radiator element;

said supporting and excluding actions in said maintaining step including surrounding said conical radiator with a selected thickness of abrasion and impact force-resistant resin material of increased dielectric constant with respect to atmospheric air.

15. The method of communicating modulated ultra high radio frequency energy radio signals from an air delivered earth penetrating munitions device to a nearby above ground ultra high radio frequency receiver apparatus of claim 14 wherein said supporting and excluding actions further include covering said conical radiator, at high radio frequency voltage locations thereof, with sufficient of said abrasion and impact force-resistant increased dielectric constant resin material to further limit effects of penetration detuning on said conical radiator.

16. The method of fabricating a size limited, impact resistant, stable electrical characteristics ultra high radio frequency energy signal-communicating antenna assembly for an earth penetrating munitions device comprising the steps of:

suspending electrically conductive ground plane and ultra high radio frequency energy radiating conductor elements in selected element configuration, perpendicular, electrically isolated locations;

supporting said radiating conductor element in said selected element configuration shape by embedding said element within a first quantity of a hardenable resin dielectric material;

adding to said first quantity of a hardenable resin dielectric material a second quantity of said material of size and location capable of fixing said electrically conductive ground plane and radiating conductor elements in said suspended, perpendicular, electrically isolated locations;

supplementing said first and second quantities of said hardenable resin dielectric material with a third quantity of said material capable of permanently supporting said ground plane and radiating conductor elements in said suspended, perpendicular, electrically isolated locations in the presence of earth penetration munitions device generated deceleration forces of selected magnitude;

complementing said first, second and third quantities of said hardenable resin dielectric material with a fourth quantity of said material disposed in selected amount and location on said antenna assembly to isolate said radiating conductor element from electrical characteristic destabilizing debris and moisture products of said munitions device earth penetration;

curing said first, second, third and fourth quantities of hardenable resin dielectric material into a unified mass receivable in a selected cavity portion of said earth penetration munitions device.

17. The method of fabricating a size limited, impact resistant, stable electrical characteristics ultra high radio frequency energy signal-communicating antenna assembly for an earth penetrating munitions device of claim 16 wherein said hardenable resin dielectric material is a urethane resin.

18. The method of fabricating a size limited, impact resistant, stable electrical characteristics ultra high radio frequency energy signal-communicating antenna assembly for an earth penetrating munitions device of claim 17 wherein said hardenable resin dielectric material is a heat curable urethane resin of Durometer Shore hardness D scale of elasticity.

19. The method of fabricating a size limited, impact resistant, stable electrical characteristics ultra high radio frequency energy signal-communicating antenna assembly for an earth penetrating munitions device of claim 18 wherein said hardenable resin dielectric urethane resin material is Synair D-65 Monothane.

20. The method of fabricating a size limited, impact resistant, stable electrical characteristics ultra high radio frequency energy signal-communicating antenna assembly for an earth penetrating munitions device of claim 16 further including the step of tuning an electrical length characteristic of said antenna following said hardening step, said tuning including removing lengthwise portions of said radiating conductor element and said hardenable elastic resin dielectric material.

21. The method of fabricating a size limited, impact resistant, stable electrical characteristics ultra high radio frequency energy signal-communicating antenna assembly for an earth penetrating munitions device of claim 16 further including the step of tuning an electrical length characteristic of said antenna assembly by adding length shortening electrical capacitance in series with said radiating.

* * * * *